United States Patent [19]

Tamagawa et al.

[11] Patent Number: 4,508,751

[45] Date of Patent: Apr. 2, 1985

[54] PROCESS FOR THE PREPARATION OF HIGHLY SIZED PAPER

[75] Inventors: Shigehisa Tamagawa; Tetsuro Fuchizawa, both of Fujinomiya, Japan

[73] Assignee: Fuji Photo Film Co., Ltd., Kanagawa, Japan

[21] Appl. No.: 478,257

[22] Filed: Mar. 24, 1983

[30] Foreign Application Priority Data

Mar. 26, 1982 [JP] Japan ..... 57-48244

[51] Int. Cl.[3] ..... B05D 3/06

[52] U.S. Cl. ..... 427/44; 427/411; 430/538

[58] Field of Search ..... 427/44, 411; 430/538

[56] References Cited

U.S. PATENT DOCUMENTS 4,364,971 12/1982 Sack et al. ..... 427/44

*Primary Examiner*—John E. Kittle
*Assistant Examiner*—James J. Seidleck
*Attorney, Agent, or Firm*—Toren, McGeady and Stanger

[57] ABSTRACT

A process for the preparation of a highly sized paper which comprises subjecting a paper containing a sizing agent to electron radiation. A photographic support showing reduced developing solution permeation is also. disclosed.

10 Claims, No Drawings

PROCESS FOR THE PREPARATION OF HIGHLY SIZED PAPER

This invention relates to a process for the preparation of a highly sized paper. More particularly, this invention relates to a process for the preparation of a highly sized paper suitably employed for preparing a water-proof photographic support.

There has been previously employed a measure involving incorporation of a sizing agent into a paper for increasing the sizing degree, and developed a variety of sizing agents for the purpose. The sizing agents include an internal sizing agent to be incroporated into a pulp stock and a surface sizing agent to be impregnated into or coated over a surface of a paper sheet. Both sizing methods, however, are in common with each other in that a hydrophobic material is applied to a paper sheet.

As the internal sizing agent, a rosin size is widely employed, because it is less expensive and is easy to handle. However, the increase of sizing degree provided by the rosin size is under limitation, even though the rosin size is employed in a large amount. Moreover, the sizing degree provided by the rosin size is extremely poor against an alkaline solution and an organic solvent. For the reasons, in most cases the rosin size is now employed only for the preparation of an ordinary paper.

When a paraffin wax size or a fatty acid size is employed in place of the rosin size, a relatively high sizing degree can be given as compared with the case using a rosin size. In that case, however, the use of a large amount of such an agent is apt to bring about various drawbacks such as water pollution in the paper making stages and deterioration of the strength of the paper produced. Accordingly, both are not satisfactory in the practical use.

Recently, there has been broadly marketed a reactive sizing agent which forms a chemical bonding with pulp fibers. Representative examples of the reactive sizing agent include an alkylketene dimer. The alkylketene dimer shows relatively high sizing effect against water, as is said in general. However, the sizing effect of the alkylketene dimer against an aqueous organic solvent is rather poor. Other reactive sizing agents such as alkenyl succinic anhydride and fatty acid anhydride also have drawbacks in the stability of their solutions.

As for the surface sizing agent, a wax emulsion can be mentioned as a representative one. The wax emulsion, however, has a drawback, that is, the emulsion is apt to be destroyed under the mechanical shearing given by a pressing roll to produce undesired spots over a paper sheet.

As described hereinbefore, the prevention of permeation of a solution is not attained to a satisfactory level by the simple incorporation of a sizing agent into a paper sheet.

The unsatisfactory sizing effect of the simple use of a sizing agent is particularly serious problem for a paper sheet to be employed for the preparation of a water-proof photographic support.

The water-proof photographic support comprises a paper sheet coated with a hydrophobic polyolefin resin on both surfaces thereof. Even though the water-proof photographic support is provided with a hydrophobic resin layer, it is apt to be soiled by a developing solution permeating from an exposed edge portion in a developing procedure, because hydrophilic wood pulp fibers constituting the paper sheet are liable to draw the developing solution into the paper sheet. A known sizing agent, as well as a known combination of sizing agents, cannot provide satisfactory sizing effect to the paper sheet of the water-proof photographic support. This is particularly because the developing solution contains an alkaline agent and an organic solvent such as alcohol. For this reason, a sizing system capable of preventing effectively the permeation of an aqueous solution containing an alkaline agent and an organic solvent such as a photographic developing solution is highly desired.

Accordingly, an object of the invention is to provide a process for the preparation of a paper highly sized against water, an alkaline solution, an organic solvent.

Another object of the invention is to provide a process for the preparation of a sized paper which is improved in the water pollution occurring in the paper preparation process.

A further object of the invention is to provide a process for the preparation of a highly sized paper suitably employable for the preparation of a waterproof photographic support.

A still further object of the invention is to provide a photographic support improved in prevention of permeation of a developing solution.

These objects are attained by the present invention, that is, a process for the preparation of a highly sized paper which comprises subjecting a paper containing a sizing agent to electron radiation.

The invention is now further described as follows.

The paper is mainly composed of a pulp material and at least one sizing agent. Examples of the pulp material include cellulose-type pulps such as wood pulp, straw pulp and esparto pulps. A part of the cellulose-type pulp can be replaced with a synthetic pulp material. Representative examples of the sizing agent include a rosin, a wax, a fatty acid, an epoxidated fatty amide, an alkylketene dimer, an alkenyl succinic anhydride, and acid anhydride. Other sizing agents or a combination of known sizing agents are also employable. The paper can further contain other internal additives generally employed in the paper preparation such as a paper strength increasing agent, a fixing agent, a preserving agent, a filler, and an antistatic agent, and/or a surface sizing agent.

According to the invention, the electron radiation can be applied to both surfaces of the paper sheet containing a sizing agent. However, only one surface of the paper sheet can be subjected to the electron radiation, if desired.

The electron radiation can be applied to the paper sheet by means of a known apparatus, for instance, an apparatus employing a scanning system, a double scanning system, and a curtain beam system. The electron radiation is generally produced at an acceleration voltage of 100–1000 KV, preferably 100–300 KV. The dosage of electron radiation absorbed by the paper sheet generally ranges from 0.5 to 30 megarads, and preferably ranges from 2 to 20 megarads. If the acceleration voltage is lower than 100 KV, the energy is too low to penetrate the paper sheet. If the acceleration voltage is so high as to exceed 1000 KV, the efficiency of radiation energy actually absorbed for improving the sizing effect is lowered. A radiation dosage less than 0.5 megarad does not cause a satisfactory improvement of the sizing effect. On the other hand, a radiation dosage exceeding 30 megarads is not efficiently absorbed by the paper sheet, and sometimes causes exorthermic reaction in the paper sheet.

The effects of the application of electron radiation to a paper sheet containing a sizing agent according to the invention is, in the first place, that a paper sheet is highly sized against permeation of a variety of solutions and solvents, and in the second place, that an amount of the sizing agent to be employed can be curtailed so that troubles caused by the employment of a sizing agent such as a water pollution are reduced.

The paper prepared by the invention is particularly advantageous for use as paper required to have high water resistance, such as a wrapping paper, a paper sheet employed for preparing paper cups, a glossy paper, and a paper sheet to be employed for preparing a photographic support. However, the paper of the present invention is also advantageously employable as an ordinary paper.

For the preparation of photographic support from the paper sheet containing a sizing agent and subjected to electron radiation, the paper sheet is coated with a polyolefin resin, such as polyethylene or a copolymer of ethylene and other copolymerizable monomers, in a conventional manner.

The present invention is further illustrated by the following examples, which are by no means intended to restrict the invention.

EXAMPLE 1

To an aqueous slurry containing wood pulp fibers (CBKP) beaten to the Canadian freeness level 350 cc. was added sodium stearate in the amount of 1.0% by weight based on the absolutely dried pulp content. Further added was aluminium sulfate in the amount of 1.5% by weight based on the absolutely dried pulp content. The pulp slurry was then processed in a conventional manner to give a paper sheet weighing 100 g./m$^2$ and of 120 $\mu$m thick.

The paper sheets were then subjected to electron radiation at various absorption levels. The paper sheets subjected to electron radiation at levels of 2 megarads, 5 megarads and 10 megarads were named Test Samples No. 1-2, No. 1-3, and No. 1-4, respectively.

For comparison, Test Sample No. 1-1 subjected to no electron radiation was prepared.

These four test samples were then evaluated by a liquid permeation liability test. The liquid permeation liability test was carried out in accordance with JIS P-8140 (Cobb Test Method), employing water as the liquid. The temperature and period for the test were 20° C. and 3 minutes, respectively. The results of the tests are set forth in Table 1.

TABLE 1

| | Test Sample | Permeation of Water |
|---|---|---|
| 1-1 | No radiation (control) | 30 g./m$^2$ |
| 1-2 | 2 Megarads radiation | 27 g./m$^2$ |
| 1-3 | 5 Megarads radiation | 24 g./m$^2$ |
| 1-4 | 10 Megarads radiation | 20 g./m$^2$ |

The results set forth in Table 1 clearly indicate that the water permeation liability is remarkably reduced by the electron radiation according to the invention.

EXAMPLE 2

To an aqueous slurry containing wood pulp fibers (CBKP) beaten to the Canadian freeness level 300 cc. was added sodium stearate in the amount of 0.7% by weight (based on the absolutely dried pulp content, the same, hereinafter). Further added were 1.0% by weight of aluminum sulfate, 0.5% by weight of polyamide-polyamine-epichlorohydrin (Kymene 557, trade mark of DIC-HERCULES Co., Ltd., Japan), and 0.3% by weight of alkylketene dimer (Aquapel, trade mark of DIC-HERCULES Co., Ltd.). The pulp slurry was then processed in a conventional manner to give a paper sheet weighing 150 g./m$^2$ and 160 $\mu$m thick.

The paper sheets were then subjected to electron radiation at various absorption levels. The paper sheets subjected to electron radiation at levels of 2 megarads, 5 megarads and 10 megarads were named Test Samples No. 2-2, No. 2-3, and No. 2-4, respectively.

For comparison, Test Sample No. 2-1 subjected to no electron radiation was prepared.

One surface (back surface) of each paper sheet was then coated with polyethylene having the density of approximately 0.980 g./cm$^3$ to form a coating layer of approximately 0.33 mm thick. Another surface (front surface) of the paper sheet was coated with polyethylene having the density of approximately 0.960 g./cm$^3$ containing titanium dioxide (10% by weight) to form a coating layer of approximately 0.030 mm thick. Thus, water proof photographic supports were prepared.

Thus prepared four test samples were then evaluated on the prevention of permeation of a photographic developing solution.

The evaluation was carried out by the procedures described below.

The photographic support sample was cut to produce a test strip of 8.28 cm wide. The test strip was then developed in Color Paper Automatic Development Apparatus RPV-409 Type (available from Noritu Koki Co., Ltd., Japan), and subjected to eye measurement (through a loupe) of the depth of developing solution permeation from the edge section face.

The results of the tests are set forth in Table 2.

TABLE 2

| | Test Sample | Depth of Permeation |
|---|---|---|
| 2-1 | No radiation (control) | 0.55 mm |
| 2-2 | 2 Megarads radiation | 0.42 mm |
| 2-3 | 5 Megarads radiation | 0.38 mm |
| 2-4 | 10 Megarads radiation | 0.30 mm |

The results set forth in Table 2 clearly indicate that the water proof photographic support obtained from the paper sheet subjected to electron radiation according to the invention shows an excellent prevention on the permeation of a photographic developing solution, which contains an alcohol and an alkaline agent.

We claim:

1. A process for the preparation of a sized paper resistant to permeation of water, an alkaline solution and an organic solvent which comprises subjecting a paper containing sodium stearate in combination with aluminum sulfate to electron radiation in such a manner that the dosage of the electron radiation absorbed by the paper reaches a range of 0.5 to 30 megarads.

2. The process as claimed in claim 1 in which said dosage of electron radiation absorbed by the paper reaches a range of 2 to 20 megarads.

3. The process as claimed in claim 1 in which the electron radiation is applied to the paper at an acceleration voltage of 100–1000 KV.

4. The process as claimed in claim 2 in which the electron radiation is applied to the paper at an acceleration voltage of 100–1000 KV.

5. A process for the preparation of a photographic support resistant to permeation of a developing solution containing an aqueous alkaline solution and an organic solvent which comprises subjecting a paper sheet containing sodium stearate in combination with aluminum sulfate to direct electron radiation in such a manner that the dosage of electron radiation absorbed by the paper reaches a range of 0.5 to 30 megarads, and coating both surfaces of the paper.

6. The process as claimed in claim 5 in which said paper further contains polyamide-polyamine-epichlorohydrin and alkylketene dimer.

7. The process as claimed in claim 5 in which said dosage of electron radiation absorbed by the paper reaches a range of 2 to 20 megarads.

8. The process as claimed in claim 6 in which said dosage of electron radiation absorbed by the paper reaches a range of 2 to 20 megarads.

9. The process as claimed in claim 5 in which the electron radiation is applied to the paper at an acceleration voltage of 100–1000 KV.

10. The process as claimed in claim 6 in which the electron radiation is applied to the paper at an acceleration voltage of 100–1000 KV.

* * * * *